US007408151B2

(12) United States Patent
Keller

(10) Patent No.: US 7,408,151 B2
(45) Date of Patent: Aug. 5, 2008

(54) DYNAMIC BIASING OF ION OPTICS IN A MASS SPECTROMETER

(75) Inventor: Craig A. Keller, Menlo Park, CA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 357 days.

(21) Appl. No.: 11/174,016

(22) Filed: Jun. 30, 2005

(65) Prior Publication Data

US 2006/0017003 A1 Jan. 26, 2006

Related U.S. Application Data

(60) Provisional application No. 60/679,702, filed on May 10, 2005, provisional application No. 60/585,349, filed on Jul. 1, 2004.

(51) Int. Cl.
*H01J 49/00* (2006.01)
*H01J 1/50* (2006.01)

(52) U.S. Cl. ..... 250/288; 250/286; 250/287; 250/282; 250/292; 156/345.28

(58) Field of Classification Search ..... None
See application file for complete search history.

*Primary Examiner*—Jack I. Berman
*Assistant Examiner*—Zia R. Hashmi
(74) *Attorney, Agent, or Firm*—Townsend and Townsend and Crew LLP; Gerald T. Gray

(57) ABSTRACT

A device for dynamically biasing an ion optic element, for example, in a mass spectrometer. The device includes a voltage source, a first ion optical element coupled with the voltage source, a second ion optical element resistively coupled with the first ion optical element; and a pulse generator capacitively coupled with the second ion optical element. The pulse generator is configured to apply a series of pulses to the second ion optical element. In steady state operation, a dynamic voltage bias is generated between the first ion optical element and the second ion optical element. The dynamic voltage bias is controllable by controlling the characteristics of the applied pulses, such as the pulse width, pulse amplitude, and pulse repetition rate of the applied pulses.

29 Claims, 2 Drawing Sheets

DYNAMIC BIASING OF ION OPTICS IN A MASS SPECTROMETER

CROSS-REFERENCES TO RELATED APPLICATIONS

This application claims the benefit of U.S. provisional application Ser. No. 60/585,349, filed Jul. 1, 2004, which is hereby incorporated by reference in its entirety.

BACKGROUND OF THE INVENTION

The present invention relates in general to mass spectrometers, and in particular to laser desorption and ionization mass spectrometers ("LDI-MS").

In the field of analytical chemistry, a technique that has demonstrated impressive development and popularity during the past decades involves the use of a Time-of-Flight Mass Spectrometer ("TOF-MS"). A TOF-MS generally comprises an ion source, an ion optic assembly, a flight tube (free flight region) and an ion detector. More generally the TOF-MS can be divided into ion source, mass analyzer, and detector systems.

The ion source in an LDI/TOF-MS includes a probe element, on which the sample is presented, and a laser, which directs pulses of laser light at the sample, desorbing analyte molecules from the probe surface and ionizing them.

The ion optic assembly, a sub-assembly of a TOF-MS, focuses and accelerates ions from the ion source before they enter the free flight region of the TOF-MS. For example, the ion optic assembly of a TOF-MS may be realized with three electrodes: (1) A source element (also called a repeller lens or sample plate); (2) an extraction lens element and (3) an acceleration lens element. Sometimes a fourth electrode is placed between the extraction lens and the acceleration electrode. In most LDI-MS instruments the source element comprises means for engaging a probe, such as pins that mate with holes in the probe, or a groove into which the probe is slid. In this way the sample is connected to the source element. In some instruments conducting grids are used in the apertures of the some or all of the lenses to limit the penetration of electric fields through these apertures from neighboring high field regions. For example, a grid across the aperture of the extraction element might be used to prevent penetration of the field between the extraction and acceleration elements into the space between the extraction and the source elements. While grids help to control the electric field between the extraction lens and the source they can also degrade the performance of the ion optics because ion can collide with grids or the small apertures in the grids can act as focusing elements themselves.

Modern LDI/TOF-MS instruments use pulsed ion extraction (PIE) to improve the resolution of the mass spectrometer. In pulsed extraction, independent potentials can be placed on the source and extraction lens to create an appropriate electric field between the plates before laser desorption/ionization. In some applications, the source and extraction elements are initially held at specific potentials so as to create an essentially zero field at or near the surface of the source. In some cases, it may be desirable to create an initial field at the surface of the source that retards or accelerates ions generated from the sample. In any case, a laser pulse desorbs and ionizes analyte molecules from the source, creating a plume of ions between the source and the extractor. At a predetermined time interval after ionization, predetermined voltages, an extraction pulse, are applied to the source and the extraction elements to create an accelerating field that propels ions of the appropriate charge through the aperture in the extraction lens and into the following optics where the ions are generally focused and accelerated before entering the free flight region. (See, e.g., Weinberger et al., Time-of-flight Mass Spectrometry, Encyclopedia of Analytical Chemistry R. A. Meyers (Ed.) pp. 11915-11984 John Wiley & Sons Ltd, Chichester, 2000.)

In current LDI/TOF-MS systems, a voltage source is typically required for each voltage difference between two ion optic elements. For example, in a system with pulsed ion extraction, voltage sources are typically required to 1) set the voltage of the ion source relative to the acceleration element, 2) set the DC voltage of the extraction element relative to the ion source, and 3) generate a pulse that is capacitively coupled to the extraction element to generate the extraction field. While separate voltage sources for each of these provides full control of the voltages of the ion optic elements, it also adds to the expense of the instrument.

There is a growing need to use mass spectrometers as assay devices. To be useful in this way mass spectrometers need to be sensitive and low in cost. Sensitivity requires the ability to detect as many ions as possible that are desorbed from the sample plate. To achieve this, appropriate ion optics and voltage sources are required. The cost of a mass spectrometer can be reduced by eliminating unnecessary elements and replacing expensive elements with low-cost versions.

It is an object of this invention to provide a low cost mass spectrometer without compromising the high sensitivity.

BRIEF SUMMARY OF THE INVENTION

The present invention provides circuits, systems and methods for providing a desired voltage bias between an ion source and an ion extraction element in a mass spectrometer device using characteristics of an applied pulse that usually do not affect the operation of the mass spectrometer. In certain aspects, a device according to the present invention includes a voltage source, a first ion optical element coupled with the voltage source, a second ion optical element resistively coupled with the first ion optical element; and a pulse generator capacitively coupled with the second ion optical element. The pulse generator is configured to apply a series of pulses to the second ion optical element. In steady state operation, a voltage bias is generated between the first ion optical element and the second ion optical element. The magnitude of this dynamically generated voltage bias is automatically or manually controllable, e.g., by controlling the characteristics of the applied pulses, such as the pulse width, pulse amplitude, and pulse repetition rate of the applied pulses.

According to an aspect of the present invention, a device is provided that typically includes a voltage source, a first ion optical element coupled with the voltage source, and a second ion optical element resistively coupled with the first ion optical element. The device also typically includes a pulse generator capacitively coupled with the second ion optical element, wherein the pulse generator is configured to apply a plurality of pulses to the second ion optical element, the plurality of pulses having a controllable pulse pattern and controllable pulse shapes so that in steady state operation, a steady state voltage bias is generated between the first ion optical element and the second ion optical element, wherein the voltage bias is greater than about 0.1% of the pulse amplitude. In one aspect, the device is implemented in a mass spectrometer system. In certain aspects, the voltage reference is configured to provide a voltage level of between about 0 kV and about ±30 kV.

In another aspect of the present invention, a method is provided for applying a steady state voltage bias between a first ion optical element and a second ion optical element in a device. The method typically includes providing a device having a voltage supply, a first ion optical element coupled with the voltage supply, a second ion optical element resistively coupled with the first ion optical element, and a pulse generator capacitively coupled with the second ion optical element. The method typically includes applying a plurality of pulses to the second ion optical element using the pulse generator, the plurality of pulses having a controllable pulse pattern and controllable pulse shapes configured so that in steady state operation, a steady state voltage bias is generated between the first ion optical element and the second ion optical element.

In another aspect, this invention provides a device comprising: (1) a voltage source; (2) a first ion optical element coupled with said voltage source; (3) a second ion optical element resistively coupled with said first ion optical element, wherein the second ion optical element comprises an aperture; (4) a pulse generator capacitively coupled with said second ion optical element and (5) a third ion optical element coupled to ground, wherein the second ion optical element is located between the first and third ion optical element and the aperture is electrically unshielded.

In yet another aspect, a method is provided for applying a steady state voltage bias between a first ion optical element and a second ion optical element in a device having a voltage supply, a first ion optical element coupled with the voltage supply, a second ion optical element resistively coupled with the first ion optical element, and a pulse generator capacitively coupled with the second ion optical element. The method typically includes applying a plurality of pulses to the second ion optical element using the pulse generator, the plurality of pulses having a controllable pulse pattern and a controllable pulse shape, and adjusting one or more of the pulse pattern and the pulse shape so that in steady state operation, a steady state voltage bias is generated between the first ion optical element and the second ion optical element.

For a further understanding of the nature and advantages of the present invention, reference should be made to the following description taken in conjunction with the accompanying drawings.

DETAILED DESCRIPTION OF THE INVENTION

The embodiments of the present invention provide circuits and methods for using a pulsed voltage to dynamically generate and control the DC bias on an ion optical element or a lens. Since both the pulsed voltage and the dynamically generated DC bias appear on the ion optical element, this is particularly useful on lens elements that can or must be driven with a time-dependant voltage, for example, a lens element driven with a pulse to provide pulsed extraction in an ion source.

The present invention provides a circuit that may be used to create a steady state voltage bias between the ion extraction and ion source elements using a single pulse generating power supply, or voltage source. In response to a steady stream of voltage pulses, a steady state voltage bias, or dynamic bias, is created at a time relative to each laser pulse in a series of laser desorption pulses. In operation, the pulse characteristics, such as pulse amplitude and pulse width, may be adjusted to control the magnitude of the steady state bias. With appropriate selection of pulse characteristics, the dynamic bias in the extraction region may be used, for example, for accelerating ions away from the ion source, reducing the initial velocity of desorbed ions, or creating a field free region before an extraction pulse is applied. Additionally, only a single pulsed voltage source is required to generate the desired steady state voltage bias between the ion extraction and source elements and to apply the extraction pulse. This circuit has advantages in certain LDI/TOF-MS designs. In particular, the use of a single power supply decreases the cost of the instrument.

Figure 1:
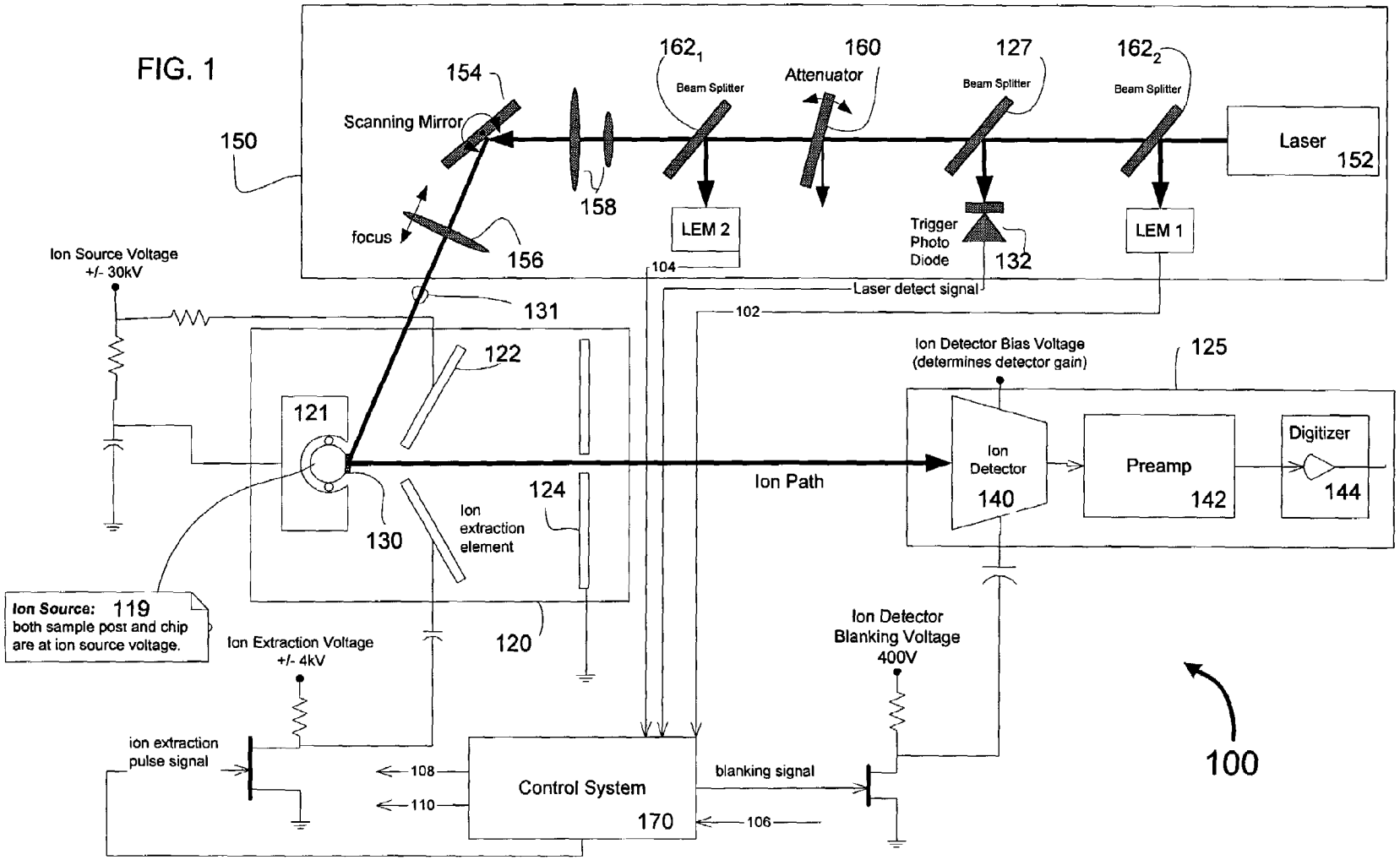
FIG. 1 is a block diagram of an embodiment of an LDI-MS device.

FIG. 1 is an exemplary block diagram of a LDI-MS device 100, that may incorporate a circuit arrangement configured to dynamically bias an ions lens of a mass spectrometer according to the present invention. Briefly, as shown, mass spectrometer device 100 includes ion optics system 120, ion detection system 125, light optics system 150 and control system 170.

As shown, ion optics system 120 includes a repeller lens 121, an extractor plate 122 and an acceleration lens 124. As shown, extractor 122 is conical in shape and acceleration lens 124 is planar, however, other geometries may be used as desired. For example, both extractor 122 and acceleration lens 124 may be planar. Both extractor 122 and acceleration lens 124 have apertures which together define a flight path for ions desorbed from sample 130. In one design that improves the sensitivity of the instrument, the aperture in the conical extraction lens does not include a grid or screen. While this allows more analyte ions to pass through the lens, it also allows penetration of an accelerating electrical field from the ground plate into the space between the source and the extraction lens. This is a problem when one desires there to be a zero field at the surface of the sample at the time of desorption/ionization to facilitate pulsed extraction. One solution is to use different power supplies to hold the extraction plate at a higher potential than the source. Another solution is to generate a dynamic bias between the extractor and the source which, in the configuration described above, counteracts the field penetration from the acceleration element, creating a zero field near the source for subsequent pulsed extraction. The generation of the dynamic bias is described in detail below.

A flight tube (not shown) or other enclosure typically encloses the ion optics system, the detection system, and the flight path between the ion optics system 120 and the detection system 125. This enclosure is typically evacuated so as to prevent unwanted interactions during flight of the ions.

Detection system 125 includes an ion detector 140 and a digitizer module 144. Ion detector 140 detects ions desorbed from sample 130 and produces a signal representing the detected ion flux. Examples of suitable detection elements include electron multiplier devices, other charge-based detectors, and bolometric detectors. Examples include discrete and continuous dynode electron multipliers. Digitizer 144 converts an analog signal from the detector to a digital form, e.g., using an analog-to-digital converter (ADC). A pre-amplifier 142 may be included for conditioning the signal from the ion detector 140 before it is digitized.

Mass spectrometer device 100 also includes a light optics system 150 that includes a light source 152. Light optics system 150 is designed to produce and deliver light to the sample 130. In preferred aspects, optics system 150 includes a plurality of optical elements that may condition, redirect and focus the light as desired so that light pulses of known energy, and focus, are delivered to the sample 130. Light source 152 preferably includes a laser, however, other light producing elements may be used, such an arc lamp or flash tube (e.g., xenon). The delivered light is preferably provided as one or more pulses of known duration, intensity and period. Thus, in preferred aspects, light system 150 generates and delivers pulsed laser light to sample 130.

Suitable laser-based light sources include solid state lasers, gas lasers and others. In general, the optimum laser source may be dictated by the particular wavelength(s) desired. Generally, the desired wavelengths will range from the ultraviolet spectrum (e.g., shorter than 350 nm) through the visible (e.g., 350 nm to 650 nm) and into the infrared (e.g., 1,000 μm) and far infrared. The light source may include a pulsed laser or a continuous (cw) laser with other pulse generating elements. Pulse generating elements may also appear in the light optics system downstream of the light source. For example, a continuous light source may be chopped to generate pulses just before the light impinges on the sample. Examples of suitable lasers include nitrogen lasers; excimer lasers; Nd:YAG (e.g., frequency doubled, tripled, quadrupled) lasers; ER:YAG lasers; Carbon Dioxide (CO2) lasers; HeNe lasers; ruby lasers; optical parametric oscillator lasers; tunable dye lasers; excimer, pumped dye lasers; semiconductor lasers; free electron lasers; and others as would be readily apparent to one skilled in the art.

In the embodiment shown in FIG. 1, light optics system 150 also includes pulse directing element 154 and focusing element 156. Additional useful optical elements might include beam expander lens set 158, attenuator element 160, beam splitter 127 and one or more additional beam splitting elements 162. Pulse directing element 154 is configured to direct the light pulse 131 from source 152 toward sample 130. In one aspect, light directing element 154 includes a mirror configured to raster the pulses along one or more directions across the sample. However, other sets of one or more reflecting, diffracting, or refracting elements may be used. Focusing element 156 operates to adjust the focus of the light pulse 131 to obtain a desired spot size and shape at the intersection of the light pulse 131 and the sample 130. For example, focusing element 156 may focus the pulse to a circular spot or an elliptical spot of a desired size. In one aspect, focusing element 156 is controlled to automatically adjust the spot size in response to a control signal from control system 170.

Optional beam expanding lens set 158 is provided to expand the pulses to facilitate beam focusing, e.g., to a small spot size. One function of a beam expander is to reduce the divergence angle of the laser beam and help make the focused diameter of the beam smaller. Attenuator element 160, also optional, may be used to condition the intensity of the pulses or a portion of the pulses. Suitable attenuation elements include fixed or variable neutral density filters, interference filters, a filter wheel, apertures, and diffusing elements. Beam splitter element 127 is included to provide a portion of each pulse to an optical detection element 132. Optical detection element 132 may include a photosensor and associated circuitry to convert detected light into an electrical signal. For example, in one embodiment, element 132 includes a photo diode that detects the light pulse and generates a signal that is used by control system 170 for various purposes, such as for verifying the timing of the laser pulses and for adjusting the timing of the ion extraction field and the characteristics of the dynamic bias (relative to the laser pulses) in ion optics system 120. For example, detection of laser pulses, which are controlled by one clock, can be used to verify or adjust the timing of ion extraction pulses or pulse generator pulses controlled by a different clock.

Beam splitting elements 162 are useful for determining output characteristics of the laser source 152. For example, beam splitter elements $\mathbf{162}_1$ and $\mathbf{162}_2$ may provide a portion of the pulse to photosensor circuit elements to determine pulse characteristics before and after conditioning by attenuator 160. It should be appreciated that alternate or additional optical elements may be used for conditioning the light pulses as desired. It should also be appreciated that alternate configurations of the various optical elements of optics system 150 are within the scope of the present invention.

Returning to the ion optics system 120 shown in FIG. 1, repeller 121 is preferably configured to receive a probe interface 119. Probe interface 119 is itself configured to engage a probe so that illumination (e.g., laser illumination) from the light optics system 150 illuminates a sample presenting surface on the probe. The sample presenting surface, as shown in FIG. 1, may include sample 130 deposited or otherwise formed thereon. A probe may include one or multiple sample presenting surfaces. Probe interface 119 is preferably designed to be in electrical contact with repeller 121 so that the probe interface 119, the probe, and the repeller 121 together act as a repeller. In one aspect, probe interface 119 is configured to translate the probe, and therefore the sample presenting surface, along at least one direction. For example, as shown in FIG. 1, the probe interface 119 may be configured to translate the probe in the z-direction, where the plane of FIG. 1 represents the x- and y-directions. For example, probe interface 119 may include, or be coupled to, a stepper motor or other element configured to translate the probe in a controllable manner.

Control system 170 is provided to control overall operation of mass spectrometer device 100, including pulse extraction operations. Control system 170 implements control logic that allows system 170 to receive user input and provide control signals to various system components.

The control logic may be provided to control system 170 using any means of communicating such logic, e.g., via a computer network, via a keyboard, mouse, or other input device, on a portable medium such as a CD, DVD, or floppy disk, or on a hard-wired medium such as a RAM, ROM, ASIC or other similar device. Control system 170 may include a stand alone computer system and/or an integrated intelligence module, such as a microprocessor, and associated interface circuitry for interfacing with the various system components of mass spectrometer device 100 as would be apparent to one skilled in the art. For example, control system 170 preferably includes circuitry for receiving trigger signals from photo diode element 132, generating timing signals and for providing timing control signals to the ion optics system (e.g., ion extraction pulse signal) and to the detection system 125 (e.g., for a blanking signal).

Figure 2:
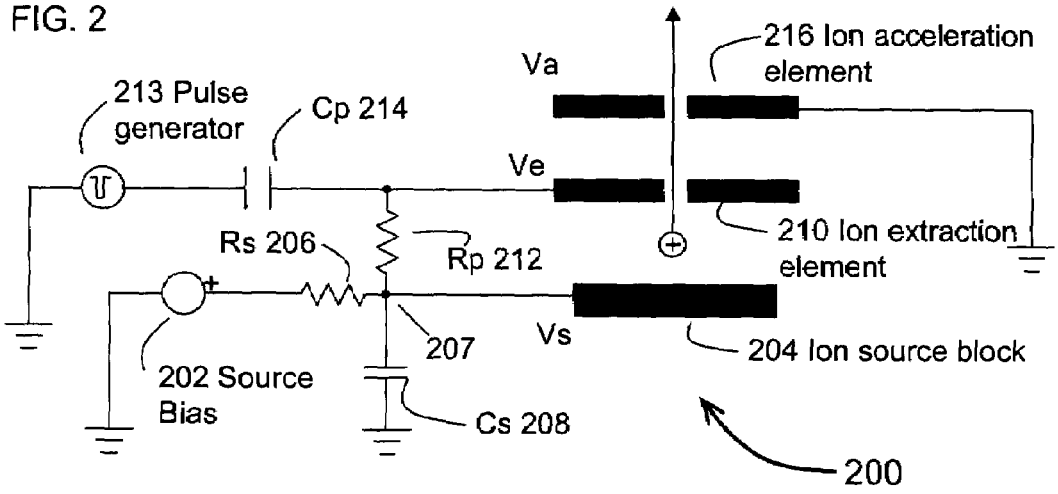
FIG. 2 is a circuit diagram for generating a voltage bias between a first and a second ion optical element, in accordance with one embodiment of the present invention.

FIG. 2 is an exemplary circuit diagram 200 for generating a voltage bias between a first ion optical element (e.g., a source) and a second ion optical element (e.g., an extraction element), in accordance with one embodiment of the present invention. For example, the circuit of FIG. 2 may be used with the LDI-MS 100 of FIG. 1 to dynamically generate and control the DC bias on an ion optical element or a lens by using a pulsed voltage, such as for example an ion optical element 122 of a mass spectrometer device 100 (shown in FIG. 1). A voltage reference 202 is coupled with a first ion optical element 204 (e.g., ion source element 119 of FIG. 1), through a source resistor 206. The source resistor 206 is not required to generate the dynamically controlled DC bias. As used herein, a voltage reference is synonymous with a voltage source, voltage supply or a regulated voltage supply. A second ion optical element 210 (e.g., ion extraction element 122 of FIG. 1) is resistively coupled with the first ion optical element 204 via a pulse resistor 212 having a resistance Rp. A pulse generator 213 is capacitively coupled with the second ion optical element 210 via a pulse coupling capacitor 214 having a capacitance Cp. Pulse generator 213 is configured to apply a series of pulses to the second ion optical element, where the pulses have a controllable pulse amplitude, pulse width and a pulse repetition rate. By controlling one or more of these pulse characteristics, a steady state voltage bias may be established and maintained between the first ion optical element 204 and the second ion optical element 210 as will be discussed in more detail below. In one embodiment, the voltage bias is greater than about 0.1% to 1% of the pulse amplitude.

Figure 3:
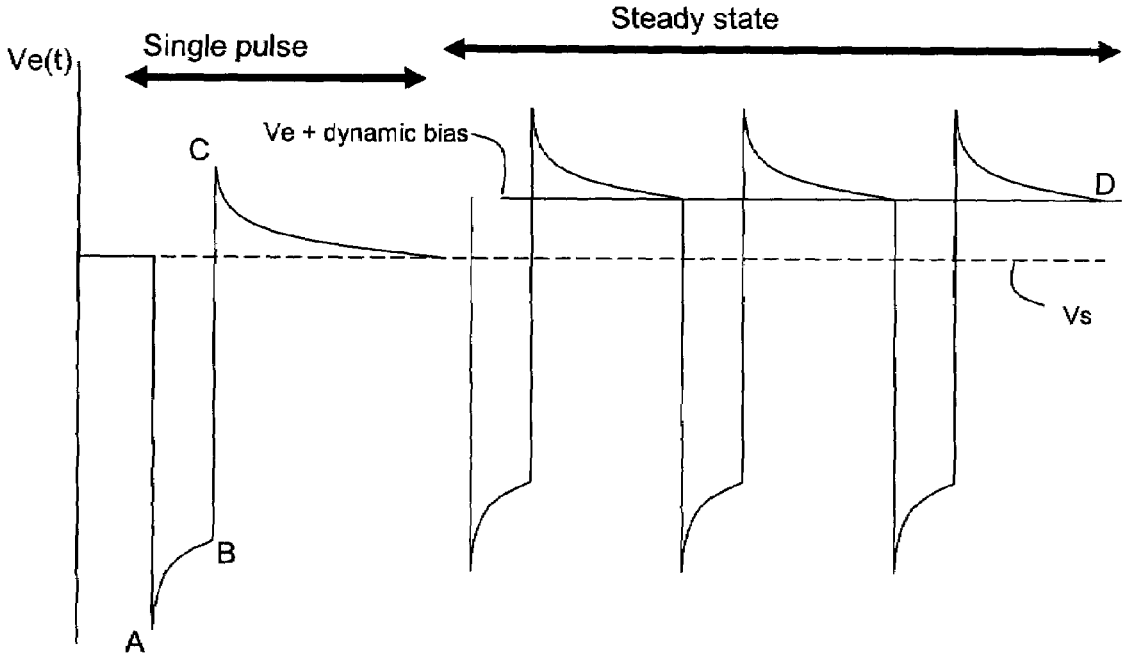
FIG. 3 is a graph of voltage vs. time for the second ion optical element of FIG. 2.

FIG. 3, which is an exemplary graph of voltage vs. time for the second ion optical element 210 (e.g., an ion extraction element) of FIG. 2, serves to describe the operation of the circuit 200 in more detail. In operation, when the system is quiescent, the second ion optical element 210, or ion extraction element, voltage Ve is equal to the source voltage Vs. When a pulse from the pulse generator 213 (in this example the pulse is taken to be a negative going square pulse, pulses of other polarities and shapes may be used within the context of the invention described here) is delivered, Ve drops from Vs to a value A. Generally, because the source is capacitively coupled to the ion extraction element by at least stray capacitances (these are not shown in FIG. 3), the voltage on the source also drops by some amount before recovering to Vs. During the pulse duration or pulse width, as current flows from the first ion optical, or the ion source, element 204 to the ion extraction element 210 via resistor 212, Ve climbs to a voltage value B. When a pulse ends suddenly, Ve immediately after the pulse is higher than the voltage before the pulse. The current flowing from the ion source element 204 to the ion extraction element 210 during the pulse duration causes the ion extraction element voltage Ve to have a higher voltage (i.e., C) immediately after the pulse than it did before the pulse (i.e., Vs). If the pulse generator stays off and does not deliver another pulse, the voltage level on the ion extraction element will return to the voltage of the ion source element Vs, as shown in FIG. 3 ("single pulse"). Note that for the dynamic generation of a DC bias, the pulse does not need to end suddenly, and if the rate of change of the trailing edge of the pulse is slow enough the overshoot described here will not necessarily occur.

However, when the pulse generator 213 is controlled to deliver pulses repeatedly, the ion extraction element is biased up to a "steady state" voltage level, for example, level D shown in FIG. 3, determined by the pulse characteristics (i.e., pulse amplitude, width, repetition rate, and shape) and the pulse period, as well as the RC characteristics of the circuit. In this manner, a baseline voltage bias for the ion extraction element 210 relative to the voltage of the ion source element 204 may be dynamically generated and controlled without the use of an additional DC power supply or voltage source. The steady state voltage bias generated between the ion extraction element and the ion source element may be controlled by adjusting any of the pulse amplitude, the pulse width, the pulse repetition rate, and the pulse shape. For example, in a TOF-MS with delayed extraction, the pulse amplitude is itself a critical parameter and it is often convenient to fix the pulse rate, so it is desirable in such a system that the voltage bias be controlled through control of the effective width of the pulse. For pulses that are not square, an effective width may be defined by dividing the area of the pulse by the amplitude of the pulse. The magnitude of the dynamic bias generated depends directly on this effective width and only to a lesser degree does it depend on the actual shape of the pulse. Often in a TOF-MS with delayed extraction, the pulse must be applied long enough for the ions of interest to leave the ion source. In this situation, the circuitry generating the dynamic bias can be designed to supply the desired bias with appropriately long pulses, e.g. with appropriate choices of Rp and Cp.

In cases in which the extractor lens shields the source from a field based on the voltage difference between the acceleration element and the extraction element, (usually this involves the use of a grid across the aperture in the extraction lens through which ions pass) the dynamic bias can be used to create a retarding field between the source and the extraction lens. This retarding field may be useful in some applications. However, there are advantages to ion optical systems without such grids. These advantages include reducing the generation of secondary ions, electrons, and sputtering and to eliminating the loss of the ions that would otherwise collide with the grid. A disadvantage of this configuration is that some part of the field between the acceleration and extraction elements will penetrate through the aperture in the extraction element to the surface of the source. This is incompatible with desorbing/ionizing analyte molecules into a free-field zone before applying the extraction pulse. The dynamic bias on the extraction element can be used to effectively cancel the penetration of the accelerating field through the extraction element, thereby effectively creating a zero field near the source at the time of desorption/ionization.

The circuit elements may be designed with many possible characteristic values, depending on the desired bias characteristics. For example, in a circuit in accordance with the embodiments of the present invention, the voltage source is configured to provide a voltage of between about 10 kV and about 30 kV. Furthermore, in this exemplary circuit, the amplitude of each of the pulses generated by the pulse generator is between about 1 kV and about 5 kV. However, it should be appreciated that different voltage levels and different pulse amplitude voltage levels may be used as desired for the particular application.

In addition, when using the circuit of FIG. 2, the voltage of the second ion optical element 210 (e.g., an ion extraction element) as a function of time can be changed by changing the pulse characteristics or by changing the circuit elements. For example, the droop of the voltage on the extraction element (from A to B in FIG. 3) for a pulse capacitively coupled to the element can be made arbitrarily small, by increasing the RC time constant, T=Rp*Cp, of the circuit in FIG. 2, for example, by adjusting the values of Rp 212, Cp 214 or both. As a second example, the impact of each pulse or series of pulses on subsequent pulses can be made arbitrarily small, by choosing Rp and Cp to make the characteristic time T=Rp*Cp shorter. In particular if this characteristic time is much shorter than the pulse period then the voltages on the extraction element due to each pulse are essentially independent the existence of previous pulses, and in this case there is essentially no dynamically generated DC bias. The dynamic bias voltage is controlled by changing the applied pulse train. For example, changes in the pulse amplitude, pulse width, pulse repetition rate, or duty cycle, can all be used to control the generated DC bias. These are special cases of using the shapes of the pulses, the number of pulses, and the distribution of pulses over time to control the dynamic bias. In particular, if some of these parameters need to be held constant for other reasons, then the remaining parameters may be used to control the generated DC bias. For example, the characteristics of some pulses might be fixed while the characteristics of other pulses are used to control the dynamic bias.

The pulse generator 213 generates pulses whose pulse characteristics (i.e., width, period, amplitude, etc.) are automatically adjustable to enable the establishment of an adjustable steady state or transient voltage bias between the first and the second ion optical element. For example, control system 170 may provide control signals to the pulse generator automatically or based on user input.

When the circuit of FIG. 2 is used in a mass spectrometer device utilizing delayed extraction, for example, as shown in FIG. 1, where a laser source is configured to generate a plurality of laser pulses that strike the ion source element, it is preferred that each of the laser pulses strikes the ion source element at a time period before the application of one of the pulse generator pulses. In one embodiment of such a mass spectrometer, the laser fires at approximately 20 Hz, the voltage pulses occur three times as often at 60 Hz, the laser firings occur a controlled time of about 0.01 μs to about 10 μs before a voltage pulse, the ion source is biased at about 10 to about 30 kV, and the pulse characteristics are an amplitude of about 1 to about 5 kV and an effective width of about 100 μs or smaller to about 1500 μs or greater. The polarity of the source voltage and the applied pulses can be chosen for the particular application. The pulse width is adjusted so that ions desorbed from the ion source by each laser pulse experience a steady state voltage bias (e.g., D in FIG. 3) of about 75 V. This steady state voltage bias ensures that desorbed ions have a field free region to travel in before an extraction pulse is applied to accelerate the ions away from the ion source. This is known as delayed extraction or time-lag-focusing. In another example, the circuit of FIG. 2 could be used in a delayed extraction mass spectrometer device and the pulse width and pulse repetition rate selected such that in steady state operation, the steady state voltage bias is sufficient to retard or to reduce the initial ion velocity of the ions desorbed from the ion source element. This has been shown in some situations to improve the achievable resolution.

Furthermore, when the circuit of FIG. 2 is used in a mass spectrometer device including an ion accelerator element 216 positioned such that the ion extraction element 210 is positioned between the ion source element 204 and the ion accelerator element 216, the acceleration field created by the accelerator element 216 may penetrate through any aperture in the ion extraction element, including the aperture defining the path between the source and the detector. This penetrating, and sometimes undesirable, field may accelerate ions between the source and ion extraction elements. In such a configuration, the pulse characteristics, e.g., pulse width and pulse period, can be selected such that in steady state operation, the dynamic voltage bias is sufficient to substantially cancel this penetrating field and create a field free region that is useful, for example, for time-lag focusing.

In an alternate embodiment, the circuit of FIG. 2, circuit 200, may also include a second voltage source coupled through an impedance element such as a resistor with ion extraction element 210. In this example, the generated dynamic bias does not establish the entire potential difference between the ion extraction element 210 and the ion source block 204 but can be used to adjust the total potential difference.

The embodiments of the present invention offer many advantages over existing techniques for producing baseline potentials on ion optic elements of a TOF-MS. With the techniques in accordance with the embodiments of the present invention, a separate potential, for example, from an additional power supply or a resistor network is not required to produce a baseline potential on an element whose voltage is dynamically controlled, such as for example, the pulsed extraction element in a TOF mass spectrometer. This eliminates the need for having a separate supply, and results in significant cost savings. In addition, when a resistor divider network would otherwise be used to generate the baseline potentials, the techniques in accordance with the embodiments of the present invention reduce the current required from a high voltage supply, thus resulting in additional cost savings. In addition, when a second power supply or resistive divider network is used to establish a baseline voltage on an ion optic element, the techniques in accordance with the embodiments of the present invention can be used to vary that potential without the need for other adjustable elements; this can again result in cost savings.

Accordingly, as will be understood by those of skill in the art, the present invention which is related to using a pulsed voltage to dynamically generate and control the DC bias on an ion optical element or a lens, such as for example an ion optical element of a mass spectrometer, may be embodied in other specific forms without departing from the essential characteristics thereof. For example, the particular characteristic values chosen for the circuit elements may encompass any range to provide any desired bias value between the ion optical elements. Accordingly, the foregoing disclosure is intended to be illustrative, but not limiting, of the scope of the invention, which is set forth in the following claims.

What is claimed is:

1. A device, comprising:

a voltage reference;

a first ion optical element coupled with said voltage reference;

a second ion optical element resistively coupled with said first ion optical element; and a pulse generator capacitively coupled with said second ion optical element, wherein said pulse generator is configured to apply a plurality of pulses to said second ion optical element, said plurality of pulses having a controllable pulse pattern and controllable pulse shapes so that in steady state operation, a steady state voltage bias is generated between said first ion optical element and said second ion optical element, wherein the voltage bias is greater than about 0.1% of the pulse amplitude.

2. The device of claim 1, wherein said first ion optical element is an ion source element of a mass spectrometer from which ions are desorbed and said second ion optical element is an ion extraction element of the mass spectrometer.

3. The device of claim 1, wherein the second ion optical element is coupled with said first ion optical element with an impedance element including one or more resistors, capacitors and/or inductors.

4. The device of claim 1, wherein said voltage reference is configured to provide a voltage level of between about 0 kV and about ±30 kV.

5. The device of claim 1, wherein the voltage bias is greater than about 1% of the pulse amplitude.

6. The device of claim 2, further comprising a laser source configured to generate a plurality of laser pulses for striking said ion source element, the laser pulses having a laser pulse period, wherein the laser pulse period is controlled such that each of said plurality of laser pulses strike the ion source element at a first time period before the application of one of said pulse generator pulses.

7. The device of claim 2, wherein a pulse width and a pulse period are selected such that in steady state operation, the steady state voltage bias is sufficient to retard ions desorbed from the ion source element.

8. The device of claim 2, further comprising a third ion optical element positioned such that the ion extraction element is positioned between the ion source element and the third ion optical element, wherein a pulse width and a pulse period are selected such that in steady state operation, the steady state voltage bias is sufficient to substantially eliminate the effect on ions of any field created by the third ion optical element within the region between the ion source element and the ion extraction element.

9. The device of claim 1, further comprising a second voltage source coupled with an impedance element to said second ion optical element.

10. The device of claim 1, wherein one or both of a pulse width and a pulse period are automatically adjustable.

11. The device of claim 4, wherein the amplitude of the pulses generated by the pulse generator is between about 1 kV and about 5 kV.

12. The device of claim 6, wherein the first time period is in the range between about 0.01 μs and about 10 μs.

13. The device of claim 6, further comprising a detector that detects ions desorbed from the ion source element.

14. The device of claim 1, wherein the controllable pulse pattern and controllable pulse shapes include one or more of a pulse width, a pulse amplitude, and a pulse repetition rate.

15. The device of claim 14, wherein each of the pulse width, pulse amplitude, and pulse repetition rate are independently and automatically adjustable.

16. A method of applying a steady state voltage bias between a first ion optical element and a second ion optical element in a device, comprising:

providing a device including a voltage supply, a first ion optical element coupled with said voltage supply, a second ion optical element resistively coupled with said first ion optical element, and a pulse generator capacitively coupled with said second ion optical element; and applying a plurality of pulses to said second ion optical element using the pulse generator, said plurality of pulses having a controllable pulse pattern and controllable pulse shapes configured so that in steady state operation, a steady state voltage bias is generated between the first ion optical element and the second ion optical element.

17. The method of claim 16, wherein the first ion optical element is an ion source element of a mass spectrometer from which ion molecules are desorbed and the second ion optical element is an ion extraction element of the mass spectrometer.

18. The method of claim 17, wherein said device further includes a third ion optical element positioned such that the ion extraction element is positioned between the ion source element and the third ion optical element, wherein a pulse width and a pulse period are selected such that in steady state operation, the steady state voltage bias is sufficient to substantially eliminate the effect on ions of any field created by the third ion optical element within the region between the ion source element and the ion extraction element.

19. The method of claim 17, wherein the first time period is between about 0.01 μs and about 10 μs.

20. The method of claim 17, wherein the device further includes a laser source that generates a plurality of laser pulses having a laser pulse period, the method further including controlling the timing of laser pulses such that each of said plurality of laser pulses strike the ion source element at a first time period before application of one of said pulse generator pulses.

21. The method of claim 17, wherein one or more of a pulse width, pulse period, and pulse amplitude are adjusted such that in steady state operation, the steady state voltage bias is sufficient to retard ions desorbed from the ion source element.

22. The method of claim 16, wherein the controllable pulse pattern and controllable pulse shapes include one or more of a pulse width, a pulse amplitude, and a pulse repetition rate.

23. The method of claim 22, wherein each of the pulse width, pulse amplitude, and pulse repetition rate are independently and automatically adjustable.

24. A device comprising:

a voltage source;

a first ion optical element coupled with said voltage source;

a second ion optical element resistively coupled with said first ion optical element, wherein the second ion optical element comprises an aperture;

a pulse generator capacitively coupled with said second ion optical element; and a third ion optical element coupled to ground, wherein the second ion optical element is located between the first and third ion optical element and the aperture is electrically unshielded.

25. The device of claim 24, wherein when the voltage source applies a first potential on the first ion optical element, an electric field is generated between the second ion optical element and the third ion optical element that significantly penetrates the aperture so that ions desorbed from the first ion optical element experience an electric potential.

26. The device of claim 25, wherein the pulse generator applies to the second ion optical element periodic pulses having a period and duration such that a dynamic bias is generated between the first and second ion optical elements, which bias counteracts the electric field so that ions desorbed from the first ion optical element do not experience an electric potential.

27. A method of applying a steady state voltage bias between a first ion optical element and a second ion optical element in a device having:

a voltage supply, a first ion optical element coupled with said voltage supply, a second ion optical element resistively coupled with said first ion optical element, and a pulse generator capacitively coupled with said second ion optical element;

said method comprising:

applying a plurality of pulses to said second ion optical element using the pulse generator, said plurality of pulses having a controllable pulse pattern and a controllable pulse shape; and adjusting one or more of the pulse pattern and the pulse shape so that in steady state operation, a steady state voltage bias is generated between the first ion optical element and the second ion optical element.

28. The method of claim 27, wherein the controllable pulse pattern and controllable pulse shape include one or more of a pulse width, a pulse amplitude and a pulse period or a pulse repetition rate.

29. The method of claim 28, wherein each of the pulse width, pulse amplitude, and pulse period or pulse repetition rate are independently and automatically adjustable.

* * * * *